US008028667B2

(12) United States Patent
Hayashi

(10) Patent No.: US 8,028,667 B2
(45) Date of Patent: Oct. 4, 2011

(54) VALVE TIMING ADJUSTING APPARATUS

(75) Inventor: Masashi Hayashi, Okazaki (JP)

(73) Assignee: Denso Corporation, Kariya (JP)

( * ) Notice: Subject to any disclaimer, the term of this patent is extended or adjusted under 35 U.S.C. 154(b) by 405 days.

(21) Appl. No.: 12/364,579

(22) Filed: Feb. 3, 2009

(65) Prior Publication Data

US 2009/0199798 A1 Aug. 13, 2009

(30) Foreign Application Priority Data

Feb. 8, 2008 (JP) ..... 2008-029432

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | |
|---|---|---|---|
| 5,775,279 | A | 7/1998 | Ogawa et al. |
| 6,311,654 | B1 | 11/2001 | Ushida et al. |
| 6,450,138 | B1 | 9/2002 | Kinugawa et al. |
| 6,457,447 | B1 | 10/2002 | Sato et al. |
| 6,523,511 | B2 | 2/2003 | Hase |
| 6,779,499 | B2 | 8/2004 | Takenaka et al. |
| 2001/0039933 | A1 | 11/2001 | Sato et al. |
| 2002/0043231 | A1 | 4/2002 | Hase |
| 2002/0050258 | A1 | 5/2002 | Sato et al. |
| 2009/0173298 | A1 | 7/2009 | Hayashi |

FOREIGN PATENT DOCUMENTS

| | | |
|---|---|---|
| JP | 11-50819 | 2/1999 |
| JP | 2006-132411 | 5/2006 |
| JP | 2006-220154 | 8/2006 |
| JP | 2007-120406 | 5/2007 |

OTHER PUBLICATIONS

Japanese Office Action dated Dec. 15, 2009, issued in corresponding Japanese Application No. 2008-029432, with English translation.
Japanese Office Action dated Apr. 27, 2010, issued in corresponding Japanese Application No. 2008-029432, with English translation.

*Primary Examiner* — Ching Chang
(74) *Attorney, Agent, or Firm* — Nixon & Vanderhye PC

(57) ABSTRACT

A valve timing adjusting apparatus includes a driving-side rotor, a driven-side rotor, and a bias mechanism. The bias mechanism includes a projection portion that is rotatable synchronously with the one of the driving-side and driven-side rotors and that contacts a contact part of the other one of the driving-side and driven-side rotors. The contact part includes a receiver part that is configured to increase the restoring force of the resilient member when the other one of the driving-side and driven-side rotors is rotated relative to the one of the driving-side and driven-side rotors in the advance direction or in the retard direction.

11 Claims, 7 Drawing Sheets

FIG. 3A
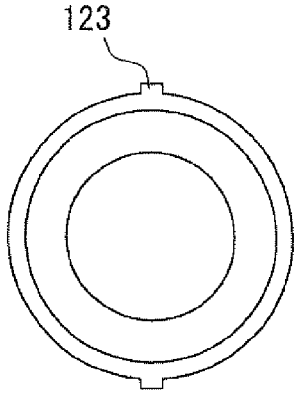
FIG. 3B
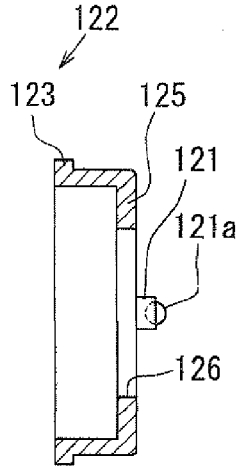
FIG. 3C
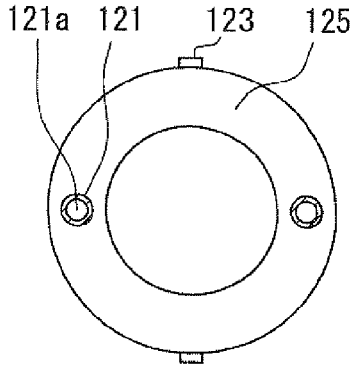
FIG. 4A
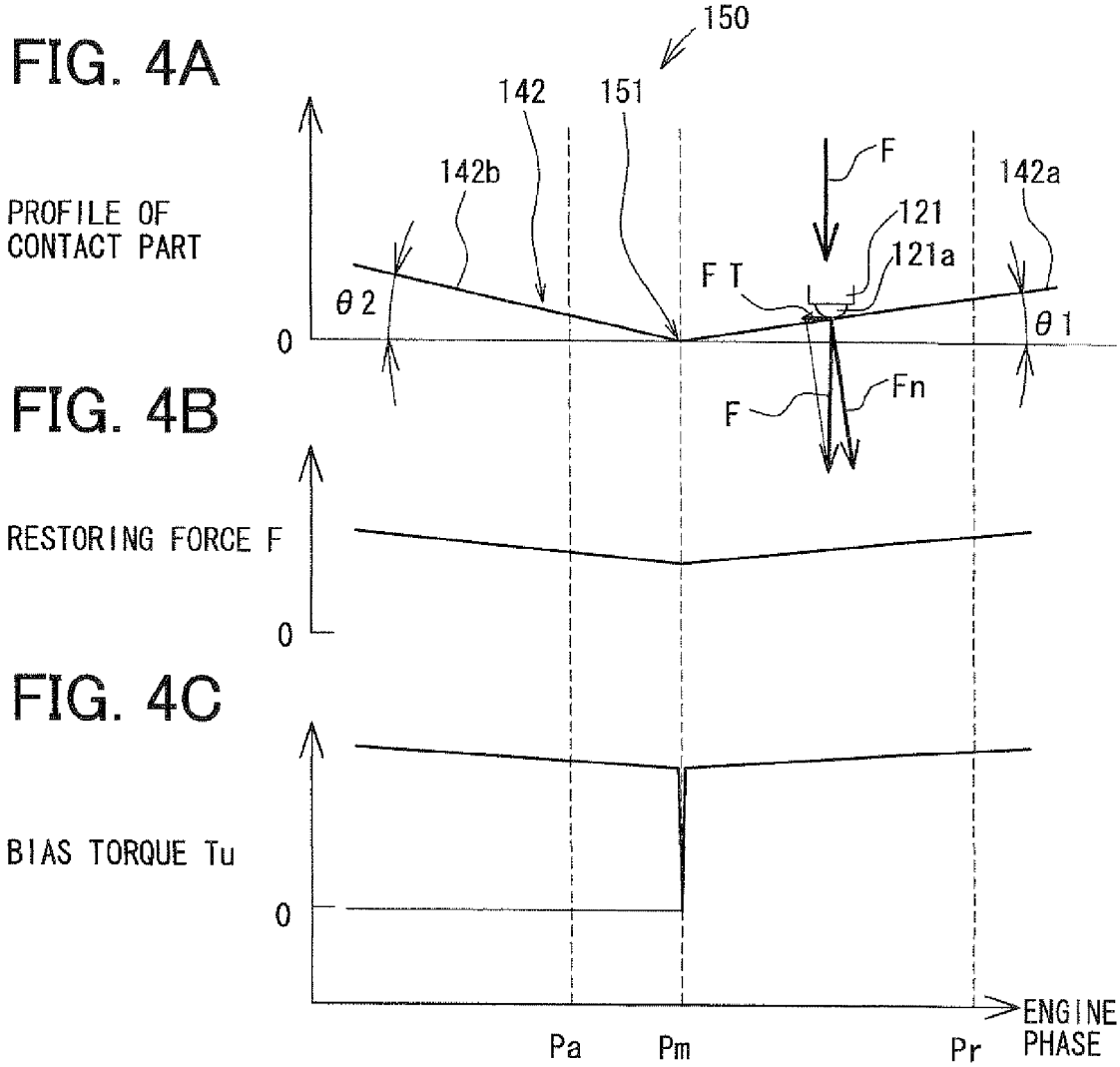
FIG. 4B
FIG. 4C 242b
242
242a
150
152 151
242b3 242b2 242b1
150a
242a1 242a2 242a3 242a4

PROFILE OF CONTACT PART
θ4
θ4
θ5
θ1
0
θ1
θ3
θ3
121a

RESTORING FORCE F
0

BIAS TORQUE Tu
0
ENGINE PHASE
Pa
Pm
Pr

VALVE TIMING ADJUSTING APPARATUS

CROSS REFERENCE TO RELATED APPLICATION

This application is based on and incorporates herein by reference Japanese Patent Application No. 2008-29432 filed on Feb. 8, 2008.

BACKGROUND OF THE INVENTION

1. Field of the Invention

The present invention relates to a valve timing adjusting apparatus for adjusting timing (valve timing) of opening and closing one of an intake valve and an exhaust valve of an internal combustion engine.

2. Description of Related Art

A conventional valve timing adjusting apparatus is known to include a housing serving as a driving-side rotor rotatable synchronously with a crankshaft and a vane rotor serving as a driven-side rotor rotatable synchronously with a camshaft. In the above valve timing adjusting apparatus, the housing includes shoes and the vane rotor includes vanes, and an advance chamber and a retard chamber are defined between the shoe and the vane arranged one after another in a rotational direction. By supplying working fluid to the advance chamber or the retard chamber, the vane rotor is rotated relative to the housing in an advance direction or a retard direction. As a result, a phase (engine phase) of the camshaft with respect to the crankshaft used for determining valve timing is adjusted (for example, JP-A-2002-357105 corresponding to U.S. Pat. No. 6,779,499).

In a valve timing adjusting apparatus described in JP-A-2002-357105, by engaging the vane rotor with the housing at the event of stopping and starting the internal combustion engine, the engine phase is held at an intermediate phase defined between a full advance phase and a full retard phase. Due to the above technique, even when the camshaft applies variable torque that attempts to rotate the vane rotor relative to the housing in the advance direction and the retard direction alternately, the engine phase is mechanically held at the intermediate phase at the event of stopping and starting the internal combustion engine, during which pressure of working fluid is relatively low.

The variable torque (torque reversal) is generated periodically such that the variable torque attempts to advance or retard the camshaft in accordance with the rotation of the internal combustion engine. For example, variable torque is caused by a spring reaction force of a valve spring of the valve that is opened and closed by the camshaft. Also, variable torque may be caused by drive reaction force from a mechanical pump in a case, where the mechanical pump is operated by the camshaft.

Also, in the valve timing adjusting apparatus described in JP-A-H10-252420 corresponding to U.S. Pat. No. 5,775,279, a torsion spring has one end connected with the driven-side rotor and has the other end connected with the driving-side rotor. More specifically, in the apparatus of JP-A-2002-357105, when the one end of the torsion spring is twisted relatively in the retard direction by the rotational force of the driven-side rotor, a restoring force in the advance direction is generated and applied to the driven-side rotor. As a result, the restoring force of the torsion spring quickly rotates the driven-side rotor relative to the driving-side rotor in the advance direction, and thereby responsibility is improved. Also, when supply of fluid is stopped, the restoring force of the torsion spring biases the driven-side rotor in the advance direction relative to the driving-side rotor. Therefore, even in a case, where variable torque from the camshaft is applied to the driven-side rotor, "fluctuation of the cam phase" that may cause noise is successfully suppressed, and thereby the engine phase is capable of being held at a full advance phase.

In JP-A-2002-357105, when the internal combustion engine is stopped, for example, the rotations of the vane rotor relative to housing in the advance and retard directions are limited by different limitation mechanisms, respectively, in order to reliably hold the engine phase at the intermediate phase, and in order to adjust the engine phase or valve timing suitable for the operational state of the internal combustion engine. Each of the limitation mechanisms includes a control pin that is actuated by fluid, and the control pin is assembled into the vane rotor. Because the control pin of each of the limitation mechanisms is actuated independently, a flow channel structure is complicated accordingly.

In contrast, the restoring force of the torsion spring is caused by torsional torque in the apparatus of JP-A-H10-252420. When rotational force in the advance direction twists the connection end portion of the torsion spring, which is connected with the driven-side rotor, the restoring force outputted to the driven-side rotor against relative rotational force is increased. Restoring force of the above torsion spring provides torque that attempts to hold the engine phase at an intermediate phase. However, it is difficult to keep the engine phase at the intermediate phase by using the restoring force of the torsion spring.

Also, even in a case, where the restoring force of the torsion spring is used to bias the engine phase to the intermediate phase in the event of starting the internal combustion engine or in the later event of stopping the supply of working fluid, the restoring force is required to be set at a magnitude equal to or greater than certain torque such that the restoring force advances or retards the engine phase against the average torque of variable torque. The restoring force characteristic of the torsion spring for ensuring the above certain torque causes an increase of torsional torque per unit change of the phase. As a result, when a tracking control for causing the engine phase to follow the target phase or another control for limiting the engine phase within the intermediate phase region is executed, the change amount of the torsional torque required to reduces the gap between the engine phase and the target phase (intermediate phase) is substantially large. Therefore, controlability may deteriorate, and thereby it may become difficult to accurately adjust the engine phase to the target phase.

SUMMARY OF THE INVENTION

The present invention is made in view of the above disadvantages. Thus, it is an objective of the present invention to address at least one of the above disadvantages.

To achieve the objective of the present invention, there is provided a valve timing adjusting apparatus for adjusting timing of a valve that is opened and closed by a camshaft through torque transmitted from a crankshaft for an internal combustion engine, the valve timing adjusting apparatus including a driving-side rotor, a driven-side rotor, and a bias mechanism. The driving-side rotor is rotatable synchronously with the crankshaft. The driven-side rotor is rotatable synchronously with the camshaft. The driven-side rotor and the driving-side rotor define therebetween an advance chamber and a retard chamber that are arranged one after another in a circumferential direction. The driven-side rotor is rotated relative to the driving-side rotor in an advance direction when working fluid is supplied to the advance chamber from an external fluid supplier working together with an operation of the internal combustion engine. The driven-side rotor is rotated relative to the driving-side rotor in a retard direction when working fluid is supplied to the retard chamber from the fluid supplier. The bias mechanism is provided to one of the driving-side and driven-side rotors. The bias mechanism includes a resilient member and a projection portion. The projection portion is rotatable synchronously with the one of the driving-side and driven-side rotors. The projection portion is rotatable relative to the other one of the driving-side and driven-side rotors and contacts a contact part of the other one of the driving-side and driven-side rotors. The projection portion and the resilient member are arranged such that the restoring force of the resilient member is applied to the other one of the driving-side and driven-side rotors. The contact part of the other one of the driving-side and driven-side rotors includes a receiver part that is configured to support the projection portion. The receiver part is configured to increase the restoring force of the resilient member when the other one of the driving-side and driven-side rotors is rotated relative to the one of the driving-side and driven-side rotors in the advance direction or in the retard direction.

BRIEF DESCRIPTION OF THE DRAWINGS

The invention, together with additional objectives, features and advantages thereof, will be best understood from the following description, the appended claims and the accompanying drawings in which:

FIG. 3A is a side view of a support shaft portion that is observed in direction III in FIG. 1;

FIG. 3B is a cross-sectional view of the support shaft portion;

FIG. 3C is another side view of the support shaft portion observed in a direction opposite from direction III;

FIG. 4A is a diagram illustrating a contact part and a receiver part of a bias mechanism of the valve timing adjusting apparatus in FIG. 1;

FIG. 4B is a diagram illustrating a restoring force (bias load) of a resilient member of the bias mechanism;

FIG. 4C is a characteristic diagram illustrating bias torque of the bias mechanism;

DETAILED DESCRIPTION OF PREFERRED EMBODIMENTS

The present invention will be described with multiple embodiments with reference to accompanying drawings. In each of the embodiments, a corresponding component is indicated by the same numeral, and thereby overlapped explanation will be omitted.

First Embodiment

Figure 1:
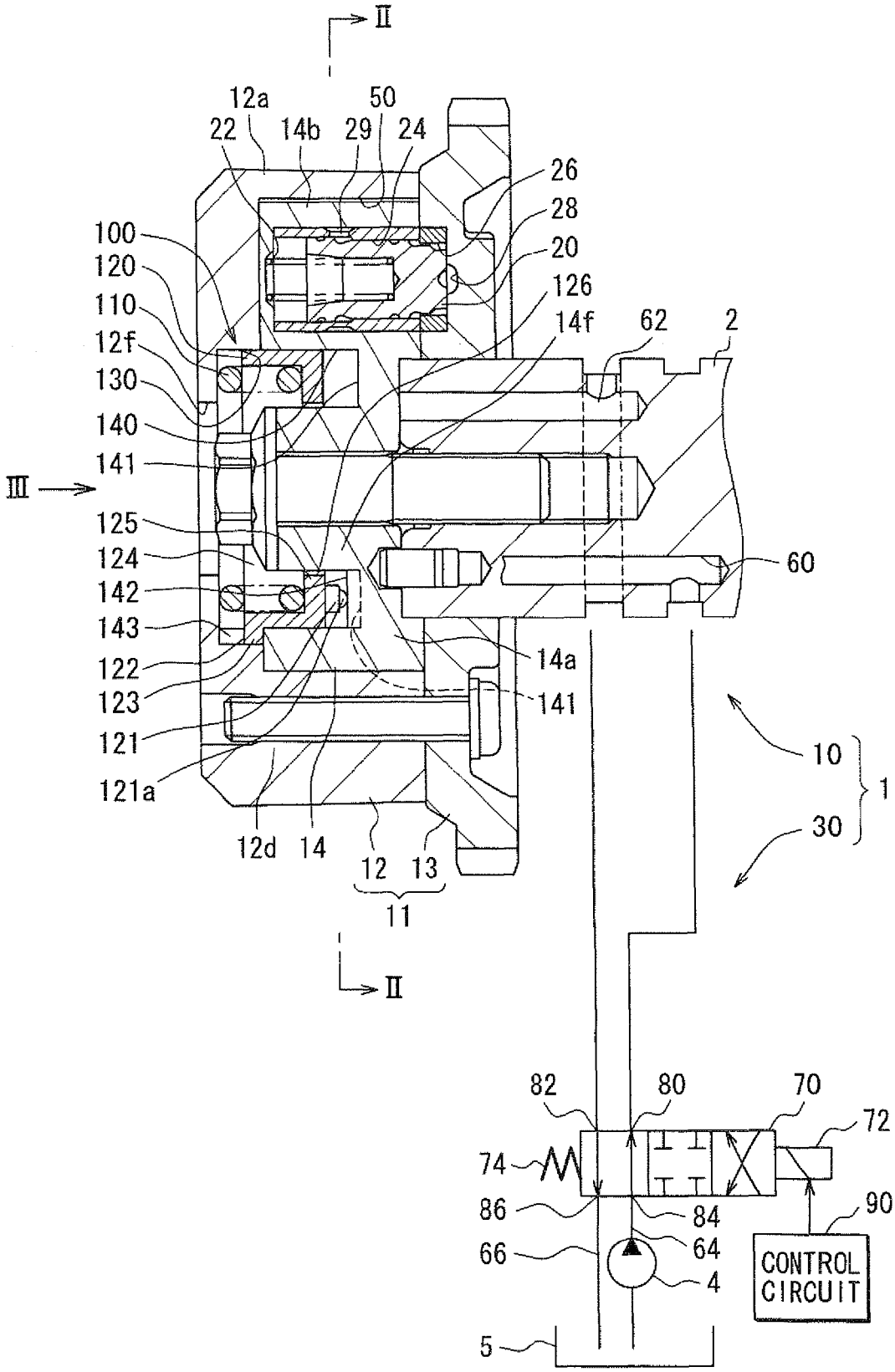
FIG. 1 is a configuration diagram illustrating a valve timing adjusting apparatus according to the first embodiment of the present invention.

FIG. 1 shows an example, in which a valve timing adjusting apparatus 1 according to one embodiment of the present invention is applied to an internal combustion engine of a vehicle. The valve timing adjusting apparatus 1 is an oil-actuated valve timing adjusting apparatus employing hydraulic oil that serves as "working fluid", and the valve timing adjusting apparatus 1 adjusts valve timing of an exhaust valve that serves as a "valve".

(Basic Configuration)

Hereinbelow, basic components of the valve timing control apparatus 1 will be described. The valve timing control apparatus 1 has a drive unit 10 and a control unit 30. The drive unit 10 is provided in a driving force transmission system that transmits driving force of a crankshaft (not shown) of the internal combustion engine to a camshaft 2 of the internal combustion engine, and the drive unit 10 is driven with the hydraulic oil. The control unit 30 controls supply of the hydraulic oil to the drive unit 10. In the present embodiment, the crankshaft serves as a "drive shaft", and the camshaft 2 serves as a "driven shaft".

(Drive Unit)

Figure 2:
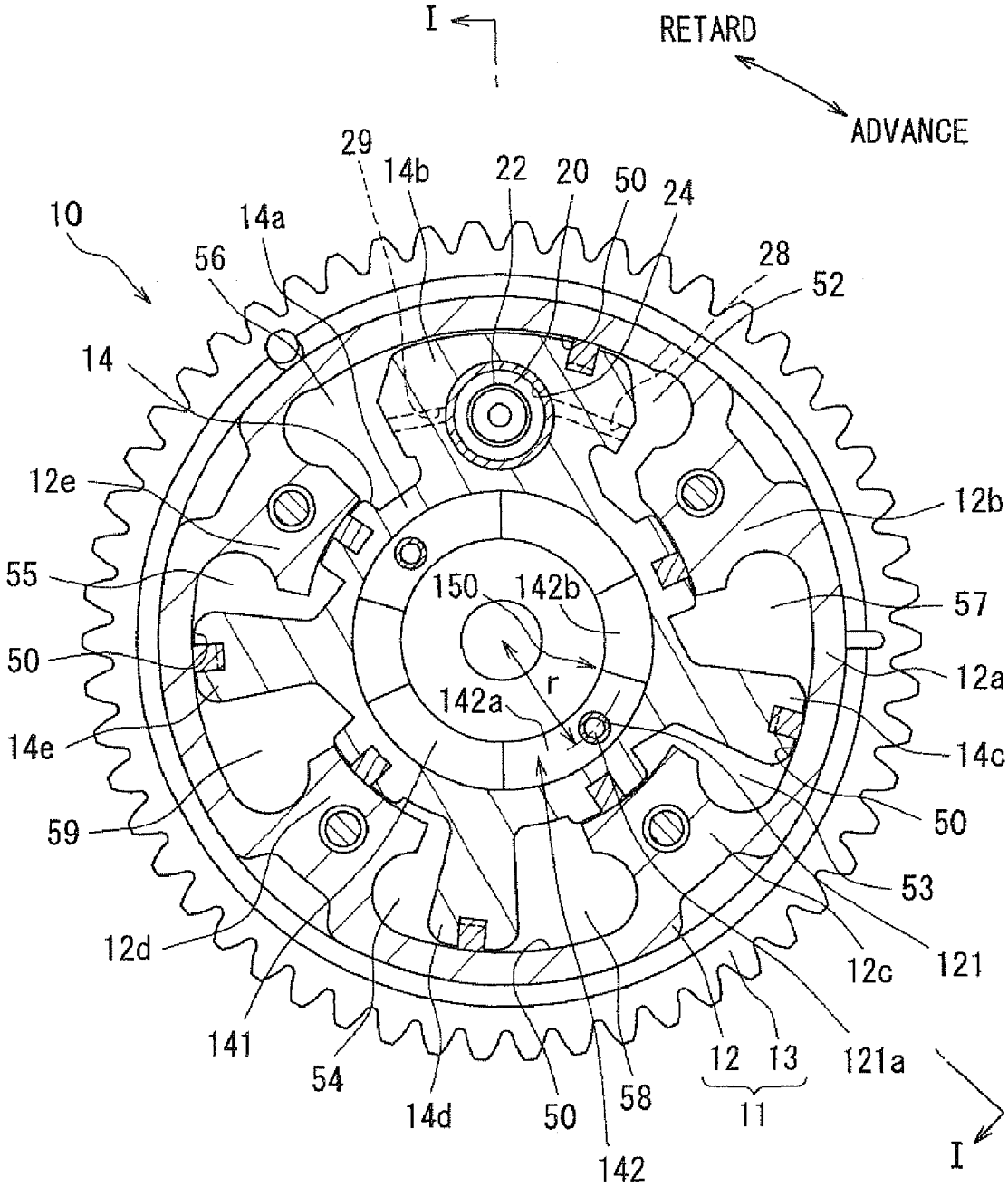
FIG. 2 is a cross-sectional view of a drive unit taken along line II-II in FIG. 1.

As shown in FIGS. 1, 2, the drive unit 10 includes a housing 11, which serves as a "driving-side rotor", and a vane rotor 14, which serves as a "driven-side rotor". The housing 11 includes a shoe housing 12 and a sprocket 13.

The shoe housing 12 is made of metal and includes a tubular portion 12*a* and multiple shoes 12*b*, 12*c*, 12*d*, 12*e*. The tubular portion 12*a* has a hollow cylindrical shape with a bottom, and the shoes 12*b*, 12*c*, 12*d*, 12*e* serves as a partitioning part.

The respective shoes 12*b* to 12*e* are arranged in the tubular portion 12*a* at positions at approximately equal intervals in the rotation direction and projected inwardly in a radial direction from the above arranged positions. A radially inward surface of each of the shoes 12*b* to 12*e* has an arcuate recess shape in section viewed in an axial direction of the housing 11, and the radially inward surface is in slide-contact with an outer peripheral wall surface of a hub portion 14*a* of the vane rotor 14. Each chamber 50 is respectively defined between adjacent ones of the shoes 12*b* to 12*e*, which are arranged adjacent to each other in the rotation direction.

The sprocket 13 is made of metal and has a circular plate shape. The sprocket 13 is coaxially fixed to an opening side of the tubular portion 12*a* through a bolt. The sprocket 13 is connected with the crankshaft through a timing chain (not shown). Due to the above structure, during the operation of the internal combustion engine, the driving force is transmitted from the crankshaft to the sprocket 13 such that the housing 11 is rotated synchronously with the crankshaft clockwisely in FIG. 2.

The housing 11 coaxially receives therein the vane rotor 14, and the vane rotor 14 has opposite longitudinal end surfaces that are slidable with a bottom wall surface of the tubular portion 12*a* and with an internal wall surface of the sprocket 13, respectively. The vane rotor 14 is made of metal and includes the hub portion 14*a*, which has a cylindrical shape, and multiple vanes 14*b*, 14*c*, 14*d*, 14*e* projecting from the hub portion 14*a*.

The hub portion 14*a* is coaxially fixed with the camshaft 2 through a bolt. In this arrangement, the vane rotor 14 is synchronously rotated with the camshaft 2 in the clockwise direction in FIG. 2 and is relatively rotatable with respect to the housing 11.

The vanes 14*b* to 14*e* are arranged at positions of the hub portion 14*a* at approximately equal intervals in the rotation direction and project outwardly in the radial direction from the above positions. The vanes 14*b* to 14*d* are accommodated in the corresponding chambers 50. The radially outward surface of each of the vanes 14*b* to 14*d* has an arcuate projecting shape in section taken by a plane perpendicular to the axial direction of the housing 11 as shown in FIG. 2, and the radially outward surface is in slide-contact with an inner peripheral wall surface of the tubular portion 12*a*.

Each of vanes 14*b* to 14*d* and the housing 11 define therebetween an advance chamber and a retard chamber by partitioning the corresponding chamber 50 into halves in the rotation direction. More particularly, a retard chamber 52 is defined between the shoe 12*b* and the vane 14*b*, a retard chamber 53 is defined between the shoe 12*c* and the vane 14*c*, a retard chamber 54 is defined between the shoe 12*d* and the vane 14*d*, and a retard chamber 55 is defined between the shoe 12*e* and the vane 14*e*. Also, an advance chamber 56 is defined between the shoe 12*e* and the vane 14*b*, an advance chamber 57 is defined between the shoe 12*b* and the vane 14*c*, an advance chamber 58 is defined between the shoe 12*c* and the vane 14*d*, and an advance chamber 59 is defined between the shoe 12*d* and the vane 14*e*.

In the above drive unit 10, when hydraulic oil is supplied to each of the advance chambers 56 to 59, the vane rotor 14 is rotated with respect to the housing 11 in the advance direction, and a phase of the camshaft 2 with respect to the crankshaft, or an engine phase that determines valve timing, is shifted in the advance direction. Then, each of the vanes 14*b* to 14*e* is brought into contact with the corresponding adjacent shoe 12*b* to 12*e* on the advance side of the vane, and thereby a rotational position of the vane rotor 14 relative to the housing 11 becomes a full advance position. In other words, the vane rotor 14 is fully advanced relative to the housing 11. Thus, the engine phase becomes a full advance phase.

In contrast, in the drive unit 10, when hydraulic oil is supplied to each of the retard chambers 52 to 55, the vane rotor 14 rotates with respect to the housing 11 in a retard direction, and the engine phase is shifted in the retard direction. When the vane 14*b* is brought into contact with the shoe 12*e* that is positioned on a retard side of the vane 14*b*, the rotational position of the vane rotor 14 relative to the housing 11 becomes a full retard position. In other words, the vane rotor 14 is fully retarded relative to the housing 11. Thus, the engine phase becomes a full retard phase.

It should be noted that the rotational position of the vane rotor 14 relative to the housing 11 shown in FIGS. 1, 2 is an intermediate position, where the starting of the internal combustion engine is allowed. Also, when the rotational position of the vane rotor 14 corresponds to the above intermediate position, the engine phase becomes an intermediate phase that is suitable for improving fuel efficiency. The relative rotational position between the rotors 11, 14, which is shown in FIGS. 1, 2, is defined as "start intermediate position", and the engine phase caused by the above relative rotational position is defined as "start intermediate phase" in the present embodiment. The engine phase in the event of starting the internal combustion engine is not limited to the start intermediate phase, and may be alternatively set as the above full advance phase. Thus, the engine phase in the event of starting is limited to one of the start intermediate phase and the full advance phase by using a lock pin 20 and the like.

As shown in FIGS. 1, 2, the drive unit 10 is further provided with the lock pin 20 that serves as "lock member" and with a bias member 22.

The lock pin 20 is made of metal and has a cylindrical column shape. The lock pin 20 is always fitted with a receiving hole 24. The receiving hole 24 is configured to open to an end surface of the vane 14*b* toward the sprocket 13 and has a bottom. In the above fitting condition, the lock pin 20 is displaceable linearly and reciprocably in a longitudinal direction that is parallel with a rotational axis of the vane rotor 14.

The bias member 22 is made of a compression coil spring and is provided in the receiving hole 24 between the bottom of the receiving hole 24 and the lock pin 20. The bias member 22 is elastically deformable toward a compressed side, and generates a restoring force that biases the lock pin 20 toward the sprocket 13.

The lock pin 20 receives the restoring force as above, and is fittable with a fitting hole 26 defined at the internal wall surface of the sprocket 13 when the lock pin 20 is displaced toward the sprocket 13 while the lock pin 20 is fitted with the receiving hole 24 in the start intermediate phase (start intermediate position). Thus, when the lock pin 20 is fitted with the fitting hole 26, the lock pin 20 locks the vane rotor 14 relative to the housing 11, and thereby prohibits rotation of the vane rotor 14 and the housing 11 relative to each other.

The fitting hole 26 is communicated with the retard chamber 52 through a retard flow channel 28. Thus, the lock pin 20 that is fitted into the fitting hole 26 receives pressure of hydraulic oil that is supplied to the fitting hole 26 through the retard chamber 52 and the retard flow channel 28. As a result, the lock pin 20 is pressed toward the bias member 22. Also, the receiving hole 24 is communicated with the advance chamber 56 through an advance flow channel 29. Thus, the lock pin 20 that is fitted with the fitting hole 26 receives pressure of hydraulic oil that is supplied to the receiving hole 24 through the advance chamber 56 and the advance flow channel 29, and thereby is pressed toward the bias member 22.

As above, when the lock pin 20 fitted with the fitting hole 26 receives pressure of oil supplied to at least one of the holes 26, 24, the lock pin 20 is displaced such that the lock pin 20 is able to be detached from or disengaged from the fitting hole 26. In the above, when the lock pin 20 is disengaged from the fitting hole 26, the locked state for prohibiting the rotation of the vane rotor 14 relative to the housing 11 is unlocked, and thereby the relative rotation of the vane rotor 14 and the housing 11 is enabled.

(Control Unit)

In the control unit 30 shown in FIG. 1, an advance flow channel 60 is provided to extend through the camshaft 2 and a journal bearing (not shown) that journals the camshaft 2, and the advance flow channel 60 is communicated with the advance chambers 56 to 59. A retard flow channel 62 is also provided to extend through the camshaft 2 and the journal bearing and is communicated with the retard chamber 52 to A supply flow channel 64 is provided to communicate with a discharge port of a pump 4 that serves as a "fluid supplier", and a drain flow channel 66 is provided to drain hydraulic oil to an oil pan 5 that is provided on an inlet port side of the pump 4. Thus, the pump 4 pumps and supplies hydraulic oil, which is pumped up from the oil pan 5, to the supply flow channel 64. The pump 4 of the present embodiment is a mechanical pump that is driven by the crankshaft such that the pump operates synchronously with an operation of the internal combustion engine. In other words, supply of hydraulic oil from the pump 4 is initiated by the starting of the internal combustion engine, and supply of hydraulic oil is continued during the operation of the internal combustion engine. Then, supply of hydraulic oil is stopped when the internal combustion engine is stopped. Therefore, pressure of hydraulic oil supplied from the pump 4 in the event of starting and stopping of the internal combustion engine is lower than pressure hydraulic oil during the operation of the internal combustion engine.

A control valve 70 is a spool valve that actuates a spool using an electromagnetic driving force generated by a solenoid 72 and a restoring force generated by a return spring 74. The control valve 70 includes an advance port 80, a retard port 82, a supply port 84, and a drain port 86. The advance port 80 is communicated with the advance flow channel 60, and the retard port 82 is communicated with the retard flow channel 62. Also, the supply port 84 is communicated with the supply flow channel 64 and is supplied with hydraulic oil from the pump 4. The drain port 86 is communicated with the drain flow channel 66 in order to drain hydraulic oil. The control valve 70 operates based on the energization of the solenoid 72 and controls a connection state of each of the supply port 84 and the drain port 86 with a corresponding one of the advance port 80 and the retard port 82.

A control circuit 90 includes, for example, a microcomputer and is electrically connected with the solenoid 72 of the control valve 70. The control circuit 90 controls energization to the solenoid 72 and controls the operation of the internal combustion engine.

In the above control unit 30, the control valve 70 is operated according to energization to the solenoid 72, which is controlled by the control circuit 90, and accordingly controls the connection state of the ports 84, 86 with the ports 80, 82. Specifically, when the supply port 84 is connected with the advance port 80, and the drain port 86 is connected with the retard port 82, hydraulic oil supplied from the pump 4 is supplied to each of the advance chambers 56 to 59 through flow channels 64, 60. Also, hydraulic oil in each of the retard chambers 52 to 55 is drained to the oil pan 5 through flow channels 62, 66. In contrast, when the supply port 84 is connected with the retard port 82, and the drain port 86 is connected with the advance port 80, hydraulic oil supplied from the pump 4 is supplied to each of the retard chambers 52 to 55 through the flow channels 64, 62. Also, hydraulic oil in each of the advance chambers 56 to 59 is supplied to the oil pan 5 through the flow channels 60, 66.

As above, the drive unit 10 and the control unit 30 of the valve timing adjusting apparatus 1 have been described. A characteristic configuration of the valve timing adjusting apparatus 1 will be described below.

(Characteristic Configuration)

As shown in FIGS. 1, 3A to 4C, in the present embodiment, the drive unit 10 includes a bias mechanism 100. The bias mechanism 100 includes a resilient member 110, a bush 120 serving as a "support shaft portion", and contact parts 142, each of which converts a "restoring force" into a "bias torque". In the above configuration, the bias mechanism 100 is configured to apply the "restoring force" generated by the resilient member 110 to the housing 11 as "bias torque" that biases the housing 11 to rotate relative to the vane rotor 14 in the advance direction. In other words, the bias mechanism 100 applies the bias torque, which is converted from the restoring force, to the housing 11 such that the housing 11 is rotated relative to the vane rotor 14 in the advance direction.

The tubular portion 12*a* of the housing 11 includes an opening part 12*f* at the bottom of the tubular portion 12*a*, and the opening part 12*f* is open to an exterior of the housing 11. The tubular portion 12*a* includes a support hole 130 (first support hole) at the bottom thereof, and the first support hole 130 opens to an end surface of the bottom of the tubular portion 12*a* opposite from the opening part 12*f*. The first support hole 130 receives therein one axial end portion of the resilient member 110 that generates the restoring force, and defines therein a part of a receiving chamber 124. The first support hole 130 includes a bottom portion provided between the first support hole 130 and the opening part 12*f*, and the bottom portion contacts the one axial end portion of the resilient member 110 such that the bottom portion limits the resilient member 110 from displacing in a longitudinal direction.

The bush 120 is made of metal and has a hollow cylindrical shape. The bush 120 is fitted coaxially with the tubular portion 12*a* of the shoe housing 12 and the hub portion 14*a* of the vane rotor 14. The bush 120 supports the first support hole 130 of the tubular portion 12*a* and a second support hole 140 of the hub portion 14*a* from radially inner sides of the first and second support holes 130, 140, for example.

The bush 120 and the first support hole 130 are displaceable relative to each other in the longitudinal direction, and a lock portion 122 causes the bush 120 and the first support hole 130 to rotate integrally with each other in the rotational direction. In other words, the lock portion 122 limits the bush 120 and the first support hole 130 from rotating independently relative to each other. The lock portion 122 includes a pair of engaging protrusions 123 and a pair of engaging grooves 143, and the engaging protrusions 123 project from the bush 120 in opposite radial directions as shown in FIG. 3. Also, each of the engaging grooves 143 is a recess that is engaged with the corresponding engaging protrusion 123.

The bush 120 and the second support hole 140 are displaceable relative to each other in the longitudinal direction, and the bush 120 and the second support hole 140 are rotatable relative to each other. The second support hole 140 includes the contact parts 142 at a bottom portion 141, and the contact parts 142 and the bottom portion 141 are provided between an inner periphery of the second support hole 140 and an outer periphery of a fixation portion 14*f* of the hub portion 14*a*.

The bush 120 includes a bottom portion 125 at an end portion of the hollow cylindrical body opposite from the engaging protrusion 123, and the bottom portion 125 contacts the other axial end portion of the resilient member 110, and the resilient member 110 is interposed between the bottom portion of the first support hole 130 and the bottom portion 125 in the longitudinal direction such that the restoring force of the resilient member 110 is generated.

Also, the bottom portion 125 includes an insertion hole 126 that opens to receive therein the fixation portion 14*f* arranged coaxially with the second support hole 140 of the hub portion 14*a*.

Also, the bottom portion 125 further includes projection portions 121 on a side of the bottom portion 125 opposite from the receiving chamber 124, and the projection portions 121 contact the respective contact parts 142. Each of the projection portions 121 includes a rolling element 121*a*, and the projection portion 121 slidably contacts the contact part 142 through the rolling element 121*a*.

As shown in FIG. 2, each of the contact parts 142 has an arcuate shape that extends in a circumferential direction of the bottom portion 141 having a circular ring shape, and the contact parts 142 are located at positions correspondingly to the two projection portions 121 of the bush 120. Each contact part 142 includes inclination portions 142*a*, 142*b* having different inclined surface shapes from each other, and the inclination portions 142*a*, 142*b* are arranged correspondingly at least within a phase adjustment range of the engine phase as shown in FIG. 4A. In the above, the phase adjustment range corresponds to an angular range between a full advance phase Pa to a full retard phase Pr.

Figure 5:
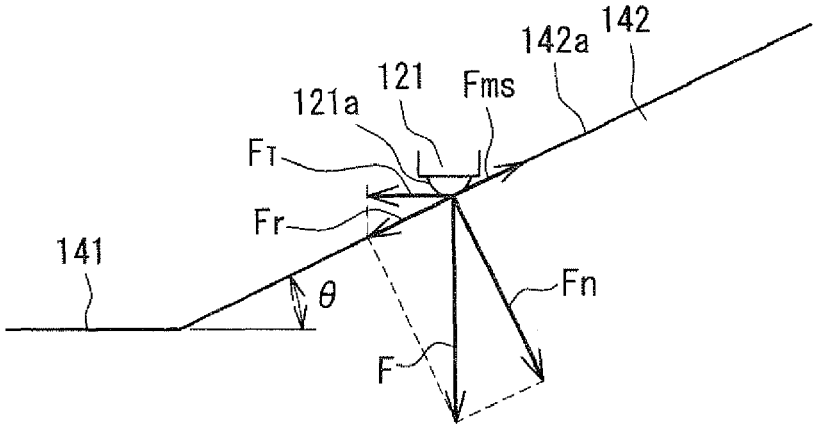
FIG. 5 is a schematic diagram for explaining an example of conversion of the restoring force into bias torque by the bias mechanism in FIG. 1.

The inclination portion of the contact part 142 has inclined surfaces that are angled relative to the bottom portion 141 by predetermined inclination angles θ (θ1, θ2 in the present embodiment) as shown in FIGS. 4A, 5, and one of the inclined surfaces is configured to be angled such that the restoring force of the resilient member 110 is increased as a function of the phase position accordingly based on a change of the phase from the full advance phase Pa to the full retard phase Pr. In other words, the inclined surface is formed to be away from a plane of the bottom portion 141 toward the full retard phase Pr.

The inclination portion of the contact part 142 causes the restoring force of the resilient member 110 to act as bias torque (assisting torque) that preadvances the engine phase toward the full advance phase during the stop of the internal combustion engine in order to prepare the starting in the next operation of the engine. In the above, the engine phase corresponds to the phase of the vane rotor 14 relative to the housing 11.

As shown in FIG. 1, the resilient member 110 is made of a compression spring, and compression load is formed in the longitudinal direction of the compression spring. As a result, magnitude of the load, or magnitude of the restoring force, is defined in accordance with a deformation amount of the spring that is compressed in the longitudinal direction. Thus, the deformation amount of the resilient member 110 is determined based on a lift amount of the contact part 142, which changes correspondingly to the inclination portions 142*a*, 142*b* (see FIG. 4A). In FIG. 4A, the lift amount corresponds to a dimension measured between an extended plane of the bottom portion 141 and the inclination portions 142*a* 142*b* of the contact part 142, for example.

In the present embodiment, set load of the resilient member 110 is formed based on the profile (cross sectional shape) of the contact part 142 that converts "restoring force" into bias torque". In general, variable torque (torque reversal) of the camshaft 2 biases the vane rotor 14 relative to the housing 11 alternately in the advance direction and the retard direction. "Set bias torque" that corresponds to "set load" is set to a magnitude such that set bias torque is greater than average torque of variable torque.

As above, the basic configuration for converting "restoring force" into "bias torque" by using the resilient member 110 and the contact part 142 of the bias mechanism 100 has been described. The limitation structure that limits the engine phase within an "intermediate phase" Pm will be described with reference to the above basic configuration. The limitation structure is different from the components (the lock pin 20, the bias member 22, and the flow channel structure of the advance and retard flow channels 28, 29) of the "lock member" that limits the engine phase to the "start intermediate phase" or the "full advance phase".

(intermediate Phase Limitation Structure)

As shown in an example in FIG. 4, the engine phase is limited to a full advance phase Pa by the lock pin 20 and the fitting hole 26 at the event of starting the engine. In addition to the above limited engine phase (full advance phase Pa) achieved by the lock pin 20 and the fitting hole 26, the intermediate phase Pm, which is determined by the shape of the inclination portions 142*a*, 142*b* of the contact part 142, is further provided.

As shown in FIG. 4A, the contact part 142 has the inclination portions 142*a*, 142*b* and has a profile (cross sectional shape) having the inclination portion 142*a* and the inclination portion 142*b* angled relative to each other. More specifically, the inclination portion 142*a* is angled relative to a plane perpendicular to the longitudinal axis of the camshaft 2 by an inclination angle θ1, and the inclination portion 142*b* is angled relative to the above plane by an inclination angle θ2 as shown in FIG. 4A. The inclination portions 142*a*, 142*b* are connected with each other at a position that corresponds to the intermediate phase Pm. It should be noted that in order to simplify the description, the magnitude of the inclination angles θ1, θ2 are generally equal to each other (θ1=θ2) in the present embodiment although the inclination angles θ1, θ2 are measured in opposite inclination directions from each other.

In the above basic configuration, the inclination portion 142*a* angled by the inclination angle θ1 achieves a main inclined surface characteristic of the contact part 142.

In the above contact part 142, because the inclination portion 142*a* angled by the inclination angle θ2 that is measured in the direction opposite from the inclination direction of the inclination angle θ1 is provided, the rolling element 121*a* of the projection portion 121 in FIG. 3 is caused to be positioned between the inclination portion 142*a* and the inclination portion 142*a*. In other words, the rolling element 121*a* of the projection portion 121 is caused to be placed at a position, at which the inclination portion 142*a* and the inclination portion 142*a* are connected with each other. A neutral region 151 serving as a receiver part 150 extends or is formed at the connection between the inclination portion 142*a* and the inclination portion 142*b*.

A normal direction biasing force Fn that serves as "first biasing force" is generated when the rolling element 121*a* contacts the contact part 142. The normal direction biasing force Fn is applied in a direction that generally equal to a direction, in which the restoring force F acts (the longitudinal direction of the bias member 110) when the rolling element 121*a* is at the neutral region 151 shown in FIG. 4A.

The normal direction biasing force Fn is also formed at the other inclined surface region of the contact part 142 other than the neutral region 151 in FIG. 4A. However, the direction of the normal direction biasing force Fn is different from the direction of the restoring force F, and thereby the difference between the directions of the forces further generates rotation component force $F_T$ that serves as "second biasing force".

The characteristic configuration of the valve timing adjusting apparatus 1 has been described. The variable torque applied to the drive unit 10 will be described below.

(Variable Torque)

Figure 6:
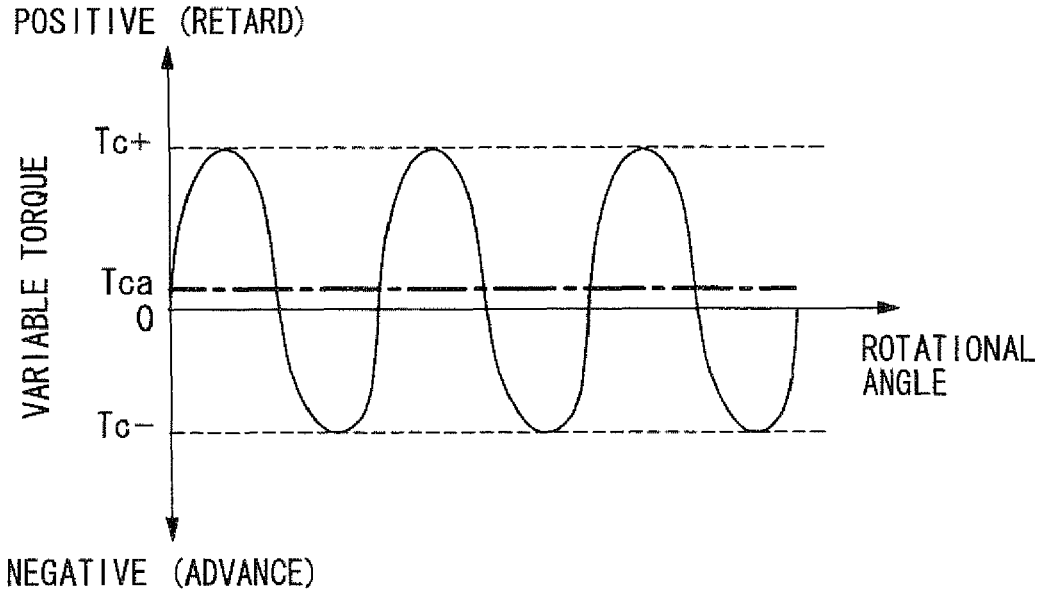
FIG. 6 is a schematic diagram for explaining variable torque.

During an operation of the internal combustion engine, variable torque is applied to the camshaft 2 and the vane rotor 14 in accordance with spring reaction force and drive reaction force. The spring reaction force is caused by a valve spring of the exhaust valve that is opened and closed by the camshaft 2, and the drive reaction force is caused by a fuel injection pump that is driven by the camshaft 2. As illustrated in FIG. 6, variable torque periodically varies between a positive torque and a negative torque. The positive torque is applied in a direction to retard the engine phase of the camshaft 2 relative to the crankshaft, and the negative torque is applied in a direction to advance the engine phase. Also, specifically, friction is generated between the camshaft 2 and the journal bearing (not shown) that journals the camshaft 2. As a result, the variable torque of the present embodiment has a characteristic, in which a peak torque Tc+ of the positive torque is greater in absolute value than a peak torque Tc− of the negative torque. Thereby, an average torque Tca of the variable torque or "average variable torque" Tca is urged or biased in the direction of the positive torque in the present embodiment. In other words, the average variable torque Tca is biased in the positive direction (retard direction) opposite from a direction, in which bias torque Ts, which is obtained by the bias mechanism 100 and the main inclined surface characteristic of the contact part 142, acts in the present embodiment. The average variable torque Tca is increased accordingly to the increase of the rotational speed of the internal combustion engine.

The variable torque applied to the drive unit 10 has been described. The characteristic operation of the valve timing adjusting apparatus 1 will be described.

(Characteristic Operation)

Characteristic operation of the valve timing adjusting apparatus 1 will be described with reference to FIGS. 2, 4A to 5. It should be noted that in order to facilitate the explanation, FIGS. 4A to 5 show the projection portion 121 of the bias mechanism 100 that integrally rotatable with the housing 11, and other components other than the projection portion 121 are omitted in FIGS. 4A to 5. Also, the inclination angle θ of the inclined surface of the contact part 142 in FIG. 5 is schematically enlarged compared with that shown in FIG. 4A for facilitating the explanation thereof.

In the above bias mechanism 100, the projection portion 121 of the bias mechanism 100 always contacts the contact part 142. Because the resilient member 110 presses the inclination portions 142*a*, 142*b* (profile) of the contact part 142 and the neutral region 151 through the projection portion 121 as shown in FIG. 4A, the restoring force F generated by the resilient member 110 has load characteristic shown in FIG. 4B.

(Operation of Basic Configuration of Bias Mechanism and Contact Part)

At the inclination portions (profile) 142*a*, 142*b* of the contact part 142, the restoring force F generates biasing force (normal direction biasing force) Fn and component force (rotation component force) $F_T$. The normal direction biasing force Fn is applied in the direction normal to the contact surface of the contact part 142, and the rotation component force $F_T$ makes a pair with the normal direction biasing force Fn and is applied in a rotational direction. The normal direction biasing force Fn is expressed as an equation of $F\times\cos\theta$ and depends on the inclination angle θ of the contact part 142, and the rotation component force $F_T$ is expressed as an equation of $F_T=Fr\times\cos\theta=F\times\sin\theta\times\cos\theta$, where another component force of the restoring force F, which is paired with the normal direction biasing force Fn, is defined as component force Fr applied in the inclined surface direction. It should be noted that inclination angle θ determines the characteristic or the profile of each of the inclination portions 142*a*, 142*b* of the contact part 142.

The bias torque Tu is defined as an equation of $Tu=F_T\times r$, where an interaxial distance measured between the rotation center axis of both the rotors 11, 14 and an axis of the projection portion 121 is defined as r as shown in FIG. 2. For example, the advance inclined surface is formed on the inclination portion 142*a*. The advance inclined surface is configured to increase bias torque Tu such that the engine phase is shifted in the advance direction. Also, the retard inclined surface is formed on the inclination portion 142*b*. The retard inclined surface is configured to increase bias torque Tu such that the phase is shifted in the retard direction; and The bias torque Tu is determined based on the restoring force F of the resilient member 110, the profile of the contact part 142, and the interaxial distance r. Also, a change rate of the bias torque Tu as a function of the engine phase is determined based on the inclination angle θ of the contact part 142 and a spring constant of the resilient member 110. In the above bias mechanism 100, it is possible to keep the change rate of the bias torque Tu as a function of the engine phase relatively lower as a small change rate shown in FIG. 4C. As a result, in a normal control, where the engine phase is caused to follow the target phase, the engine phase is accurately adjusted to the target phase.

The adjustment of the engine phase of the valve timing adjusting apparatus 1 is made based on a balance between variable torque applied to the camshaft 2, the rotational torque, and a bias torque. The rotational torque is generated by advance supply (advance supply operation), which corresponds to supply of oil to the advance chambers 56 to 59, and retard supply (retard supply operation), which corresponds to supply of oil to the retard chamber 52 to 55. The bias torque is generated by the bias mechanism 100 and the contact part 142. In an adjustment method for adjusting the engine phase by adjusting the above defined rotational torque, control of the above advance supply and the retard supply is performed to set the bias torque Tu in a magnitude that exceeds the average variable torque. Also, the change rate of the bias torque Tu as a function of the engine phase is made substantially small, for example.

A deformation amount (contraction amount) of a conventional torsion spring (assist spring) is directly defined by a change amount of the engine phase, or the relative phase between both the rotors. In the above, the deformation amount is associated with the restoring force of the assist spring. However, according to the resilient member 110 of the bias mechanism 100 of the present embodiment, a deformation amount (contraction amount) of the resilient member 110 is not directly defined by a change amount of the relative phase between both the rotors 11, 14. As a result, regardless of magnitude of the change of the relative phase between both the rotors 11, 14, the deformation amount of the resilient member 110 for the above relative phase (engine phase) is able to be made smaller. Therefore, durability of the resilient member 110 of the bias mechanism 100 is effectively improved. Thus, the valve timing adjusting apparatus 1 having the above bias mechanism 100 enables the accurate adjustment of the engine phase of the camshaft 2 relative to the crankshaft to the target phase, and also enables the high durability.

Also, in a case, where the projection portion 121 displaces along the inclined surface of the contact part 142, frictional force Fms that is applied to the projection portion 121 is defined as an equation of $Fms=\mu\times Fn=\mu\times F\times\cos\theta$, where friction coefficient determined by a condition of contact between the contact part 142 and the projection portion 121 is defined as μ. When the force Fr in the inclined surface direction exceeds frictional force Fms, the projection portion 121 is displaced along the inclined surface of the contact part 142.

Because the projection portion 121 includes the rolling element 121*a* at an end thereof and the rolling element 121*a* rolls on the contact part 142 as above, friction coefficient is able to be made substantially small in a state, where the contact part 142 contacts the projection portion 121, and thereby the projection portion 121 is smoothly movable along the inclined surface of the contact part 142. As a result, the restoring force F that forms the bias torque Tu is limited from being wasted or reduced by frictional force.

(Operation of Intermediate Phase Limitation Structure)

Followings occur at the neutral region 151 of the contact part 142. Because the neutral region 151 serving as "receiver part" exists at the connection part between the inclination portion 142*a* and the inclination portion 142*b*, the rolling element 121*a* directly contacts the connection part. Also, as a result, the rolling element 121*a* is capable of contacting parts of both the inclination portions 142*a*, 142*b* adjacent to the connection part. In a case, where the rolling element 121*a* directly contacts the connection part, the direction of the normal direction biasing force Fn becomes equal to the direction of restoring force F. In contrast, in a case, where the rolling element 121*a* contacts the adjacent parts of both the inclination portions 142*a*, 142*b* adjacent to the connection part, rotation component forces $F_T$ generated by the parts of the inclination portions 142*a*, 142*b* are substantially small or are cancelled with each other because the inclination portions 142*a*, 142*b* are angled by the inclination angle θ1 and the inclination angle θ2, respectively, in opposite inclination directions. As a result, a magnitude of resultant force of the generated normal direction biasing forces Fn becomes substantially equal to a magnitude of the restoring force F. Also, a direction, in which resultant force acts, is generally equal to a direction of the restoring force F.

At the neutral region 151, the direction of the normal direction biasing force Fn, which is generated when the rolling element 121*a* of the projection portion 121 contacts the neutral region 151, is substantially equal to the direction of the restoring force F, and rotation component force $F_T$ becomes zero or substantially small.

In contrast, the rolling element 121*a* of the projection portion 121 may contact the contact part 142 at a region different from the neutral region 151. In other words the rolling element 121*a* may contact only one of the inclination portions 142*a*, 142*b*. In the present embodiment, the region different from the neutral region 151 is named as a adjacent region located on both adjacent sides of the neutral region 151. When the rolling element 121*a* contacts the adjacent region, rotation component force $F_T$ is generated in a magnitude that is determined accordingly to the inclination angle θ1 or the inclination angle θ2 of the inclination portions 142*a*, 142*b*.

As a result, as shown in FIG. 4C, bias torque Tu generated when the rolling element 121*a* contacts the contact part 142 at the neutral region 151 is based on the substantially small rotational torque or is substantially zero. Also, bias torque Tu generated when the rolling element 121*a* is displaced from the neutral region 151 to the adjacent region, substantially large bias torque Tu based on rotation component force $F_T$ is sharply generated.

It is supposed that an intermediate phase limitation region corresponds to the neutral region 151. Even in a case, where pressure of oil supplied in the execution of an advance supply operation and the retard supply operation is relatively low during the intermediate phase limitation control, the engine phase is reliably held at the neutral region 151 due to the characteristic of bias torque Tu generated at the neutral region 151 and at the adjacent region. In the above, the advance supply operation is executed to supply oil to the advance chamber 56 to 59, and the retard supply operation is executed to supply oil to the retard chamber 52 to 55.

Also, it may be impossible to hold the engine phase at the neutral region 151 in a certain case because bias torque Tu generated at the adjacent region is insufficient. In the above case, the engine phase may be shifted in the advance direction or in the retard direction. However, bias torque Tu generated when the projection portion 121 is positioned at the adjacent region of the neutral region 151 is capable of effectively limiting "fluctuation of the cam phase" or fluctuation of the rotational position of the projection portion 121. Thereby, it is possible to easily hold the projection portion 121 within a permissible range around the neutral region 151 such that a magnitude of the fluctuation of the projection portion 121 is negligible for a usual engine operation. As above, when the projection portion 121 is positioned in the permissible range, the magnitude of the fluctuation is not influential in the operation of the engine.

(In the Event of Stopping and Starting the Engine)

During the operation of the internal combustion engine before stopping the engine, by making rotational speed of the internal combustion engine equal to or greater than a predetermined idle rotational speed Ni, pressure of hydraulic oil supplied from the pump 4 becomes equal to or greater than a predetermined threshold pressure P. In contrast, when the internal combustion engine is stopped in response to the stop command, such as turning off of the ignition switch, the rotational speed of the internal combustion engine is reduced below the idle rotational speed Ni, and thereby pressure of oil supplied from the pump 4 that is driven by the crankshaft is reduced below the threshold pressure P. As a result, in the drive unit 10, the bias torque Tu caused by the restoring force F of the resilient member 110 of the bias mechanism 100 that biases the vane rotor 14 is more dominant or greater than force applied to the vane rotor 14 caused by pressure of oil supplied to the advance chambers 56 to 59 or the retard chamber 52 to 55. As a result, the vane rotor 14 biased by the bias mechanism 100 is caused to rotate in the advance direction beyond the full retard position relative to the bush 120 that integrally rotates with the housing 11.

Because bias torque Tu generated by the characteristic of the main inclination portion 142*a* of the bias mechanism 100 assists torque that urges the vane rotor 14 to relatively rotate in the advance direction, it is possible to relatively rotate the vane rotor 14 to a certain engine position, where the lock pin 20 of the "lock member" is fitted into the fitting hole 26. In other words, it is possible to relatively rotate the vane rotor 14 to the start intermediate phase or the full advance phase, which is defined by the fitting of the lock pin 20 and the fitting hole 26. It should be noted that in the above case, the lock pin 20 is displaceable toward the sprocket 13 in response to the decrease of pressure of oil supplied from the pump 4 below the threshold pressure P. Thus, the vane rotor 14 that is held at the start intermediate phase or at the full advance phase is easily locked to the housing 11 by the fitting of the lock pin 20 into the fitting hole 26. As a result, after the stopping of the internal combustion engine, it is possible to hold the engine phase at the start intermediate phase or at the full advance phase such that the engine phase is readily positioned for the next starting of the internal combustion engine.

After the above, in the event of starting the internal combustion engine in response to a start command, such as turning on of the ignition switch, pressure of hydraulic oil supplied from the pump 4 remains below the threshold pressure P until the internal combustion engine becomes able to rotate without the assist of the starter (or until the engine completely operates). Thus, due to the principles similar to the above case of stopping of the engine, the relative rotational position of the vane rotor 14 relative to the housing 11 is held and locked at the start intermediate phase or at the full advance phase. As a result, even when the camshaft 2 receives variable torque, the engine phase is able to be held at the start intermediate phase or the full advance phase.

Also, in the present embodiment, the intermediate phase limitation structure by the bias mechanism 100 is capable of limiting the engine phase to the intermediate phase Pm that corresponds to the neutral region 151 even under the following operational conditions for the engine. In the present embodiment, the intermediate phase Pm is different from the start intermediate phase (or the full advance phase). In other words, the operational conditions include a case, where pressure of oil supplied in the advance and retard supply operation is relatively lower than pressure of oil in the conventional technique in the event of starting the engine after the lock member has been released. Also, the operational conditions include another case, where the engine phase is limited to the intermediate phase region by controlling the advance and retard supply operations when the advance and retard supply operation is stopped.

(During Operation)

During the operation of the internal combustion engine after the event of starting the engine, pressure of hydraulic oil supplied from the pump 4 is kept above the threshold pressure P. Due to the above, in the drive unit 10, the force applied to the vane rotor 14 caused by pressure of oil supplied to the advance chambers 56 to 59 or the retard chamber 52 to 55 is more dominant than the bias torque Tu caused by the restoring force F of the resilient member 110 of the bias mechanism 100, which biases the vane rotor 14. Accordingly, the control circuit 90 controls the control valve 70 to supply hydraulic oil to at least one of the advance chambers 56 to 59 and the retard chamber 52 to 55 such that the lock pin 20 is displaced toward the bias member 22, and thereby the lock state of the vane rotor 14 to the housing 11 is unlocked.

In a case, where the control circuit 90 controls the control valve 70 to supply hydraulic oil to the advance chambers 56 to 59 after unlocking the vane rotor 14, the vane rotor 14 is rotated relative to the bush 120 or the housing 11 in the advance direction. Also, in another case, where the control circuit 90 controls the control valve 70 to supply hydraulic oil to the retard chamber 52 to 55 after unlocking the vane rotor 14, the vane rotor 14 is rotated relative to the housing 11 in the retard direction.

In the above case, the change rate of the bias torque Tu relative to the engine phase caused by the bias mechanism 100 is kept substantially small. Thus, in a case, where the rotational torque, the average variable torque, and the bias torque are balanced with each other by controlling the advance supply operation and retard supply operation, the control unit 30 is enabled to easily control the advance supply operation and retard supply operation. As a result, the engine phase is accurately adjusted to the target phase.

Also, in the above operational state, it is possible to increase pressure of oil supplied in the advance supply operation and retard supply operation, rotational torque generated by the advance supply operation and retard supply operation is increased, and thereby influence of bias torque Tu caused by the bias mechanism 100 becomes substantially negligible relative to rotational torque.

In other words, it is possible to suppress the change rate of bias torque Tu as a function of the engine phase to be substantially small when the engine phase is within the engine phase adjustment range other than the intermediate phase Pm. As a result, in a case, where the advance supply operation and the retard supply operation are executed to generate rotational torque such that the generated rotational torque, average variable torque, bias torque are balanced in the control of the engine phase, control of the advance supply operation and the retard supply operation by the control unit 30 is facilitated, and thereby the engine phase is accurately adjusted to the target phase.

Bias torque is generated in a case, where the engine phase is shifted away from the intermediate phase Pm in the advance direction or in the retard direction. However, bias torque Tu is substantially small or zero when the engine phase is at the intermediate phase Pm. As a result, once the engine phase is shifted to the start intermediate phase Pm by the control of the advance supply operation and the retard supply operation by the control unit 30, the engine phase is effectively limited to (or held at) at the start intermediate phase Pm regardless of the influence of the variable torque.

As above, it is possible to effectively hold engine phase at the intermediate phase Pm region during the execution of the intermediate phase limitation control, and it is also possible to quickly execute the relative rotation of the rotors 11, 14 when the operational state is shifted from the intermediate phase limitation control to the normal control, where the engine phase is caused to follow the target phase.

Also, in the present embodiment, the configuration that holds the engine phase intermediate phase Pm region includes the bias mechanism 100 and the neutral region 151. The bias mechanism 100 includes the projection portion 121 and the resilient member 110. More specifically, the above projection portion 121 is rotatable synchronously with the rotor 11, which is one of the rotors 11, 14, and is rotatable relative to the other rotor 14. The neutral region 151 serves as "receiver part" at the contact part 142 of the other rotor 14, which the projection portion 121 contacts. As a result, the configuration that holds the engine phase at the intermediate phase Pm region is simplified substantially.

In the valve timing adjusting apparatus of the above described embodiment, the simplified configuration reliably secures the startability of the internal combustion engine, and also achieves valve timing appropriate to the operational state of the internal combustion engine.

In the present embodiment, the bias mechanism 100 includes the resilient member 110 that generates "restoring force", the bush 120 serving as "support shaft portion", and the contact part 142 that converts "restoring force" into "bias torque". In both the rotors 11, 14, the bush 120 supports the first receiving hole 130 of the tubular portion 12*a* and the second receiving hole 140 of the hub portion 14*a* from the radially inner sides of the first and second receiving holes 130, 140, for example. In the housing 11, the bush 120 is configured to be immovable relative to the tubular portion 12*a* of the shoe housing 12, and the resilient member 110 is interposed between the shoe housing 12 and the bush 120. In the above configuration, the resilient member 110 is compressed in the longitudinal direction and generates the restoring force F. Also, the vane rotor 14 is configured such that the bush 120 is slidable relative to the vane rotor 14 in the longitudinal direction and the projection portion 121 of the bush 120 is provided to the contact part 142 at the bottom portion 141 of the vane rotor 14.

In the above configuration, when the relative rotational phase between both the rotors 11, 14 is shifted in the advance direction or in the retard direction, the bias mechanism 100 rotates integrally with the housing 11, and thereby the bias mechanism 100 rotates relative to the vane rotor 14. In the above case, the bush 120 enables the bias mechanism 100 to smoothly rotate inside the second receiving hole 140 of the vane rotor 14. Also, the resilient member 110 is received between the shoe housing 12 and the bush 120. More specifically, the resilient member 110 has both end portions that are interposed between the shoe housing 12 and the contact part 142, which is at the bottom portion 141 of the vane rotor 14, through the projection portion 121. The projection portion 121 and the end portion of the resilient member 110 toward the shoe housing 12 are smoothly pressed or urged along the inner peripheries of the first receiving hole 130 and the second receiving hole 140 in the longitudinal direction.

Due to the above, the restoring force F of the resilient member 110 is effectively converted into the bias torque Tu through the projection portion 121 and the inclination portions 142*a*, 142*b* of the contact parts 142. Moreover, because the resilient member 110 is received in the shoe housing 12 and the bush 120 that is integrally rotatable with the shoe housing 12, the resilient member 110 is limited from being worn out, and also the resilient member 110 is held contracted between the shoe housing 12 and the bush 120.

Also, in the present embodiment, the projection portion 121 is provided to the bottom portion 125 of the bush 120 radially outward of the insertion hole 126. In other words, the projection portions 121 are provided to the outer peripheral portion of the bush 120. Thus, the projection portions 121 are provided at radially outer parts of the bush 120, for example. In the above configuration, it is possible to convert the same amount of the restoring force into greater bias torque Tu compared with a case, where the projection portions 121 were provided at radially inner parts of the bush 120. Thus, when the projection portions 121 are provided at radially outer parts as above, bias torque Tu is maximized within the limitation of size of the bush 120 in the radial direction. In other words, because it is possible to keep small the restoring force F of the resilient member 110 while generating sufficient bias torque Tu in magnitude, durability of the resilient member 110 is further improved.

Also, in the present embodiment, the projection portion 121 includes the rolling element 121*a* between the contact part 142 and the projection portion 121, and the rolling element 121*a* rolls on the contact part 142. Due to the above configuration, it is possible to always press the projection portion 121 against the contact part 142 through the rolling element 121*a* in the direction normal to the contact part 142. As a result, it is possible to increase flexibility in design (or flexibility in setting) of the inclined surface shape of the inclination portion (profile) of the contact part 142, and thereby it is possible to increase flexibility in design of the change rate of the bias torque Tu, which is determined by the inclination portion, relative to the engine phase.

Furthermore, because the projection portion 121 includes the rolling element 121*a* at the end thereof, the projection portion 121 is always pressed against the contact part 142 in a direction normal to the contact part 142 through the rolling element 121*a*. Also, above configuration enables the smooth movement of the projection portion 121 along the contact part 142 and facilitates the fitting of the projection portion 121 into the neutral region 151 formed on the contact part 142.

Also, in the present embodiment, because the resilient member 110 is the compression spring, hysteresis of the bias torque Tu is limited compared with a helical torsion spring or a spiral spring. Thus, the control unit 30 is capable of controlling the adjustment of the engine phase accurately to the target phase.

Also, in the present embodiment, the rotation component force $F_T$ is generated by bringing the projection portion 121 of the bias mechanism 100 into contact with the inclination portion of the contact part 142, and the rotation component force $F_T$ is set as the component force that biases the vane rotor 14 in a direction opposite from a direction of the average variable torque. Moreover, the main inclination portion 142*a* of the contact part 142 includes the inclined surface that is characterized or configured to increase the bias torque Tu accordingly based on a change of the phase of the housing 11 with respect to the vane rotor 14 toward the retard phase.

Due to the above configuration, the shape of the inclination portion (profile) is configured to set the bias torque of the contact part such that the bias torque is greater than the average variable torque and the bias torque becomes greater when the relative rotational phase (engine phase) between both the rotors 11, 14 is shifted in the retard direction. As a result, even in a case, where hydraulic oil is not sufficiently supplied during the certain operational state, such as the starting of the engine, where the variable torque is substantially influential, it is possible to reliably shift the engine phase in the advance direction.

In the present embodiment, when the one of the rotors 11, 14 is rotated relative to the other one of the rotors 11, 14 in the advance direction or in the retard direction in a condition, where the above receiver part supports the projection portion 121, the restoring force F of the resilient member 110 is increased accordingly to the rotation of the one of the rotors 11, 14. More specifically, load of the restoring force F generated by the bias mechanism 110 and the receiver part is relatively small when the projection portion 121 is positioned at the neutral region 151 of the receiver part. Also, load of the restoring force F generated when the projection portion 121 is positioned a adjacent region of the neutral region 151 in the advance direction or in the retard direction is greater than the above load generated at the neutral region 151, and is increased when the projection portion 121 is shifted in the advance direction or in the retard direction of the rotational direction.

In the above configuration, the rotational phase of the driving-side rotor relative to the driven-side rotor, or the engine phase of the camshaft 2 with respective to the crankshaft corresponds to the intermediate phase region when the projection portion 121 is positioned at the neutral region 151. In a case, where external force, such as variable torque, is applied to the driven-side rotor when the engine phase is at the intermediate phase region, and thereby the engine phase is shifted in the advance direction or the retard direction from the intermediate phase, the increased load is generated from the restoring force as above. As a result, the bias mechanism 110 and the receiver part are connected with each other, and thereby the driving-side rotor 11 and the driven-side rotor 14 are limited from rotating relative to each other.

Thus, when the engine phase is at the intermediate phase region, the driving-side rotor 11 and the driven-side rotor 14 are substantially connected with each other. As a result, even in the event of executing the intermediate phase limitation control, in which the engine phase is limited within the intermediate phase region, for example, the engine phase is capable of being kept within the intermediate phase region even when supply of working fluid is stopped.

Second Embodiment

Figure 7:
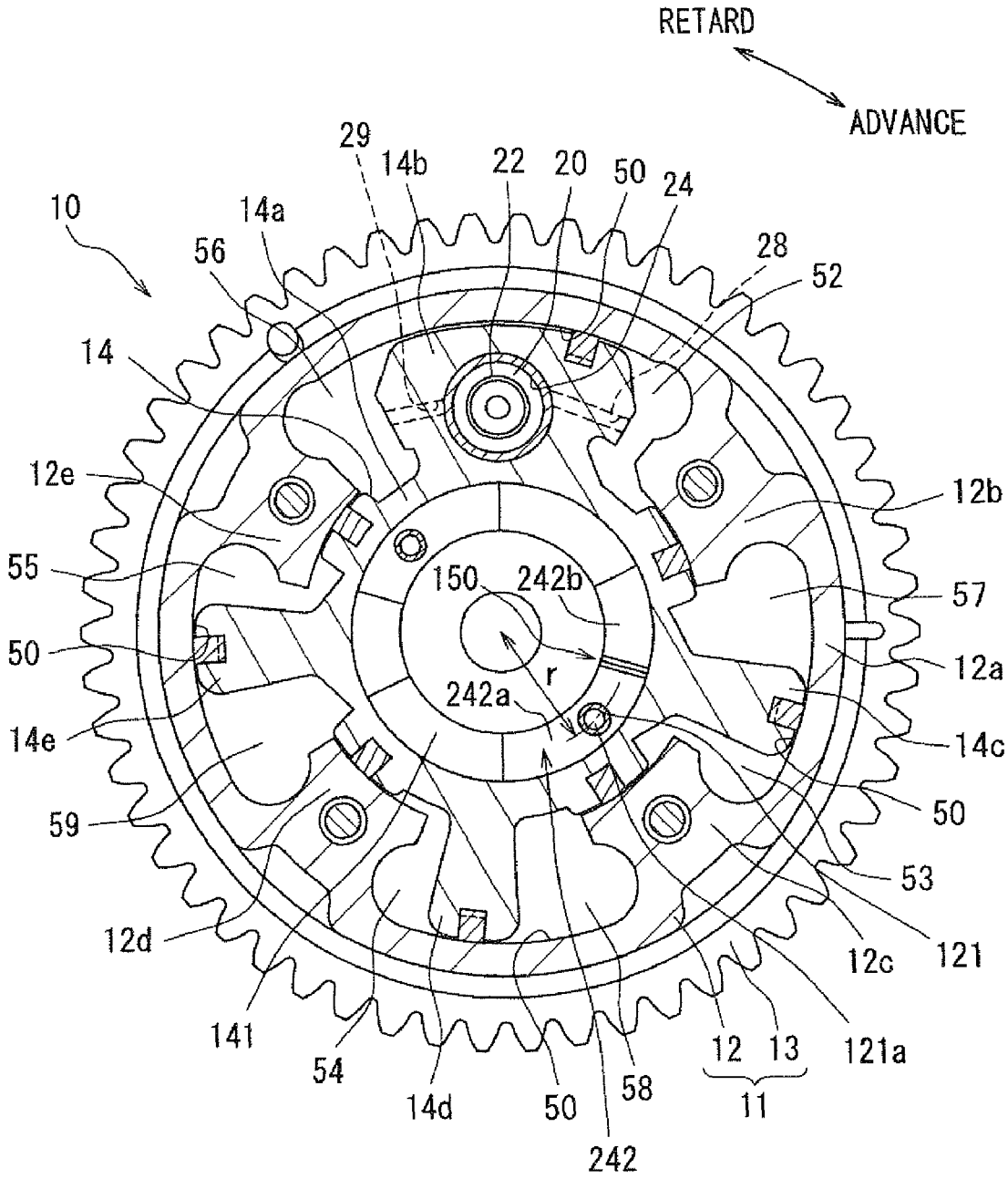
FIG. 7 is a schematic diagram illustrating a valve timing adjusting apparatus according to the second embodiment of the present invention.

The second embodiment of the present invention is shown in FIG. 7. The second embodiment is a modification of the first embodiment. In the second embodiment, a receiver part 150 includes the neutral region 151 and a permissible adjacent region 152 ranging around the neutral region 151 and extending in the advance direction and in the retard direction. Even when the projection portion 121 moves or fluctuates within the permissible adjacent region 152, the fluctuation of the projection portion 121 does not substantially influence the operation of the engine. FIGS. 7, 8 show characteristic parts of the valve timing adjusting apparatus of the second embodiment.

Figures 8A, 8B, 8C:
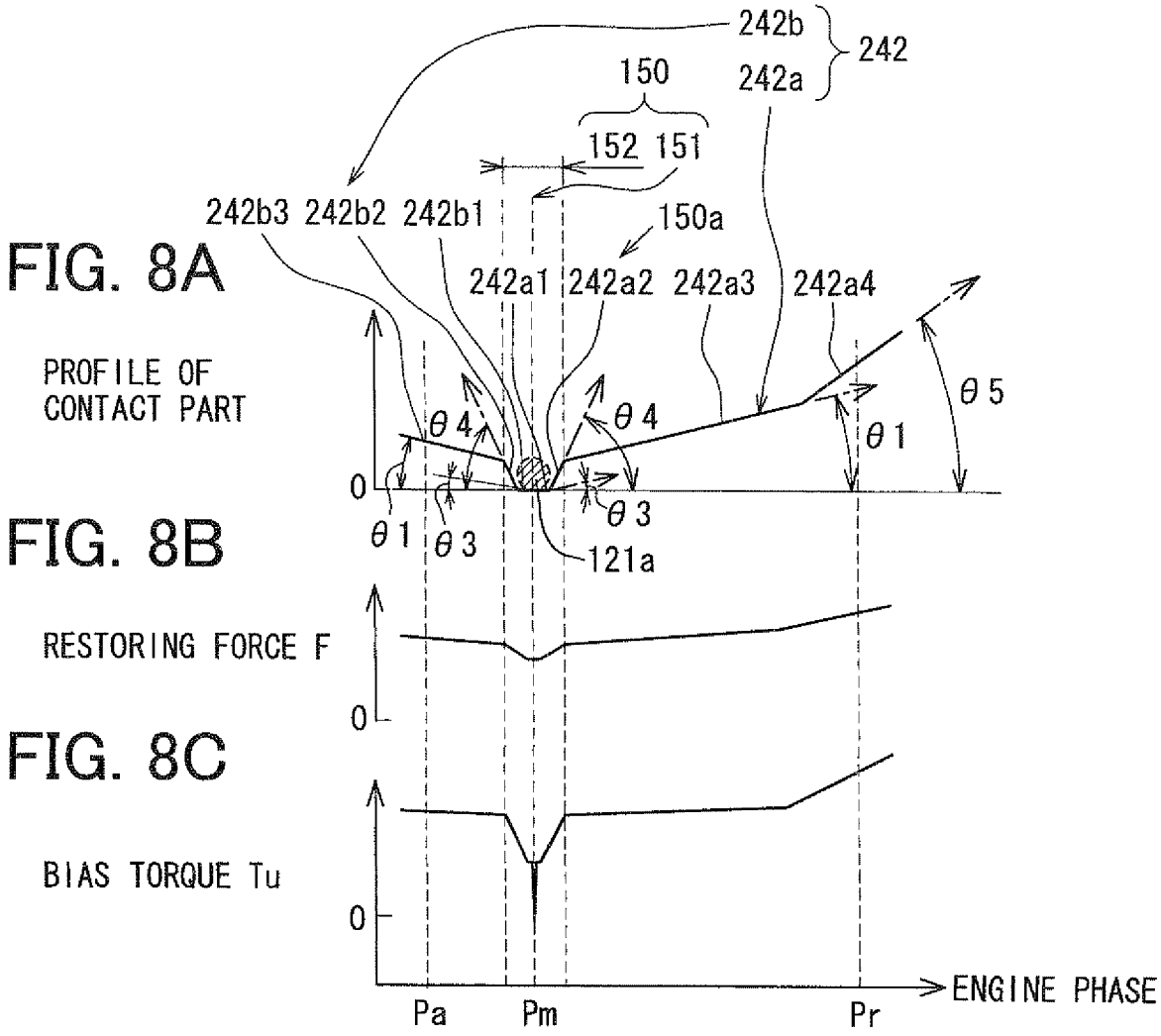
FIG. 8A is a diagram illustrating a contact part and a receiver part of a bias mechanism of the valve timing adjusting apparatus in FIG. 7.
FIG. 8B is a diagram illustrating the restoring force (bias load) of a resilient member of the bias mechanism of the second embodiment.
FIG. 8C is a characteristic diagram illustrating bias torque of the bias mechanism of the second embodiment.

As shown in FIG. 8, the bias mechanism 100 of the present embodiment includes a contact part 242 that contacts the projection portion 121. The contact part 242 includes two inclination portions 242*a*, 242*b*, each of which is sectioned into multiple inclination portion sections. The inclination portion 242*a* and the inclination portion 242*b* are angled relative to each other in opposite inclination directions relative to a plane perpendicular to the longitudinal axis of the camshaft 2. The inclination portion 242*a* and the inclination portion 242*b* are symmetrical to each other relative to another plane extending along the longitudinal axis of the camshaft 2 and passing through the neutral region 151. For example, the inclination portion 242*a* is angled anticlockwise from the perpendicular plane, and the inclination portion 242*b* is angled clockwise from the perpendicular plane as shown in FIG. 8A.

In order to simplify the description, only the inclination portion sections 242*a*1 to 242*a*4 of the inclination portion 242*a* will be described and the description of the inclination portion sections 242*b*1 to 242*b*4 of the inclination portion 242*b* is omitted. The inclination portion section 242*a*1 is angled by an inclination angle θ3 relative to the plane perpendicular to the longitudinal axis of the camshaft 2. The inclination portion section 242*a*2 is angled by an inclination angle θ4 relative to the same plane. The inclination portion section 242*a*3 is angled by an inclination angle θ1 relative to the above plane. The inclination portion section 242*a*4 is angled by an inclination angle θ5 relative to the above plane.

Also, in the inclination portion sections 242*a*1 to 242*a*4, each of the inclination portion section 242*a*1 and the inclination portion section 242*a*2 has an inclined surface section, and each inclined surface section is configured to slidably support the rolling element 121*a* of the projection portion 121. The inclined surface section of each of the inclination portion section 242*a*1 and the inclination portion section 242*a*2 is named as an inner peripheral surface 150*a* of the receiver part 150.

Also, in the inclination portion sections 242*a*1, 242*a*2, the inclination angles θ3, θ4 are set to satisfy the relation of θ3<θ4. At the inner peripheral surface 150*a* of the receiver part 150, as shown by bias torque Tu in FIG. 8C, bias torque Tu in the permissible adjacent region 152 is increased when the rolling element 121*a* of the projection portion 121 is displaced from the neutral region 151 toward the inclination portion 242*a* in the retard direction or toward the inclination portion 242*b* in the advance direction. As a result, during the intermediate phase limitation control, the engine phase is effectively held at the intermediate phase Pm region. Also when the operational state is shifted from the intermediate phase limitation control to the normal control, where the engine phase is caused to follow the target phase, it is reliably possible to quickly enable the rotation of the rotors 11, 14 relative to each other.

Also, in the inclination portion sections 242*a*1 to 242*a*4, at least inclination angles θ1, θ5 of the inclination portion sections 242*a*3, 242*a*4 are set to satisfy the following relation of θ1<θ5. As above, the phase adjustment range of the engine phase corresponds to the angular range measured from the full advance phase Pa to the full retard phase Pr. In the phase adjustment range of the engine phase includes a normal adjustment range ranging from a vicinity of the full advance phase Pa to a vicinity of the full retard phase Pr, and the contact part 242 is made of the inclination portion 242*a*3 that has the inclination angle θ1 in the normal adjustment range. The inclination angle θ1 is configured to generally correspond in magnitude to the inclination angle θ in the first embodiment.

According to the inclination portion sections 242*a*1 to 242*a*4, the bias torque when the engine phase is at the full retard phase is effectively increased while the change rate of the bias torque is kept small in the normal adjustment range of the engine phase. As a result, even in a case, where the engine phase is at the full retard phase at the stop of the internal combustion engine, it is possible to prepare the engine ready for the next event of starting the engine. Therefore, it is possible to adjust the engine phase to the target phase precisely, and also to improve the startability of the internal combustion engine.

In the present embodiment, the receiver part 150 has a recess shape that includes an inner peripheral surface 150*a* configured to generate a first biasing force Fn and a second biasing force Fr based on the restoring force F of the resilient member 110. The first biasing force Fn is applied in a direction normal to the inner peripheral surface 150*a*. The second biasing force Fr is applied in one rotational direction such that the vane rotor 14 is rotated relative to the housing 11 in the advance direction when the projection portion 121 contacts a retard part (retard side) of the inner peripheral surface 150*a*. The second biasing force Fr is applied in another rotational direction such that the vane rotor 14 is rotated relative to the housing 11 in the retard direction when the projection portion 121 contacts an advance part (advance side) of the inner peripheral surface 150*a*.

In the present embodiment, the receiver part is the recess that is configured to receive the projection portion 121 as above. Thus, the restoring force F of the resilient member 110 is reduced proportional to the longitudinal amount of the projection portion 121 that is received in the recess. Furthermore, the restoring force F of the resilient member 110 forms the first biasing force that is applied in a direction normal to the inner peripheral surface 150*a* that the projection portion 121 contacts. Also, when the projection portion 121 contacts a part of the inner peripheral surface 150*a* of the recess in the advance direction or in the retard direction of the rotational direction, the second biasing force is generated in the rotational direction. The second biasing force is increased when the projection portion 121 is displaced in the advance direction or in the retard direction of the rotational direction.

As a result, application force (rotational torque) in the rotational direction caused by the second biasing force is transmitted from the projection portion 121 to the receiver part 150. Thus, the rotational torque counters external force torque, such as variable torque, and thereby the engine phase is effectively held at the intermediate phase region during the execution of the intermediate phase limitation control.

In general, in order to effectively execute the intermediate phase limitation control, in which the neutral region 151 corresponds to the intermediate phase region, the restoring force that connects the bias mechanism 100 with the receiver part 150 may become relatively large. When the above enlarged restoring force holds the connection of the bias mechanism 100 and the receiver part 150, the bias mechanism 100 may not be quickly disengaged from the receiver part 150 when the operational state is shifted from the intermediate phase limitation control to the normal control, where the engine phase is caused to follow the target phase. As a result, the rotation of the driving-side rotor 11 relative to the driven-side rotor 14 may not quickly executed.

However, in the present embodiment, the receiver part 150 includes the inclination portion that converts the restoring force of the resilient member 110 into bias torque urging the engine phase of the other one of the rotors 11, 14 relative to the one of the rotors 11, 14 is shifted in the advance direction or in the retard direction. Furthermore, during the intermediate phase limitation control, the neutral region 151 corresponding to intermediate phase region is configured to hold the projection portion 121 between the advance inclined surface and the retard inclined surface. As a result, when the bias mechanism 100 is disengaged from the receiver part 150, bias torque may be applied to facilitate the rotation of the driving-side rotor 11 relative to the driven-side rotor 14.

Third Embodiment

Figure 9:
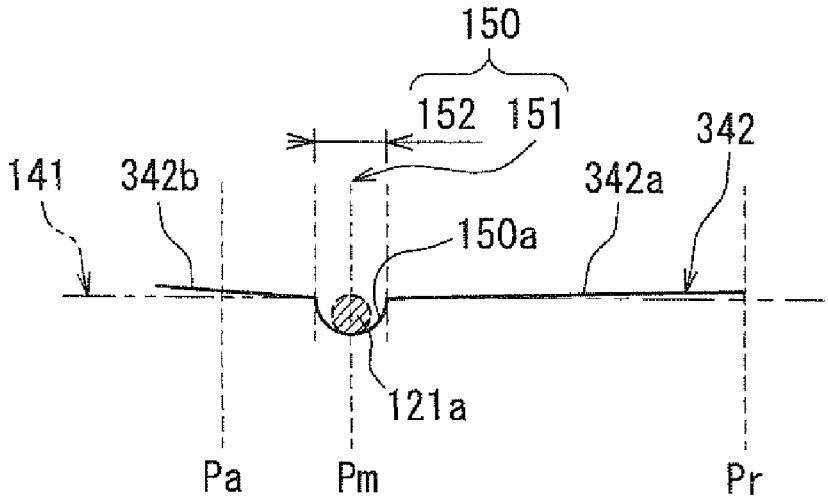
FIG. 9 is a schematic diagram illustrating a valve timing adjusting apparatus according to the third embodiment of the present invention.

FIG. 9 shows a valve timing adjusting apparatus of the third embodiment of the present invention. The third embodiment is a modification of the first embodiment. The third embodiment shows another example, in which the receiver part 150 includes the neutral region 151 and the permissible adjacent region 152 ranging over the neutral region 151 and extending in the advance direction and in the retard direction.

As shown in FIG. 9, the receiver part 150 includes two inclination portions 342*a*, 342*b*. An inclination angle of each of the inclination portions 342*a*, 342*b* relative to the plane perpendicular to the longitudinal axis of the camshaft 2 is not limited to θ1 and θ2 of the first embodiment. However, the inclination angle may alternatively be a substantially small.

Also, the inner peripheral surface 150*a* of the receiver part 150 may be curved to have a semicircular shape in section as shown in FIG. 9 because the inner peripheral surface 150*a* slidably supports the rolling element 121*a* that has a bulbous shape. Because the inner peripheral surface 150*a* has the semicircular-shape surface, bias torque Tu at the permissible adjacent region 152 of the receiver part 150 is gradually increased when the projection portion 121 is shifted from the neutral region 151 toward the inclination portion 342*a* in the retard direction or toward the inclination portion 342*b* in the advance direction. In other words, bias torque Tu within the permissible adjacent region 152 of the receiver part 150 is gradually increased when the engine phase is shifted from the intermediate phase Pm toward the full advance phase Pa or toward the full retard phase Pr.

Fourth Embodiment

Figure 10:
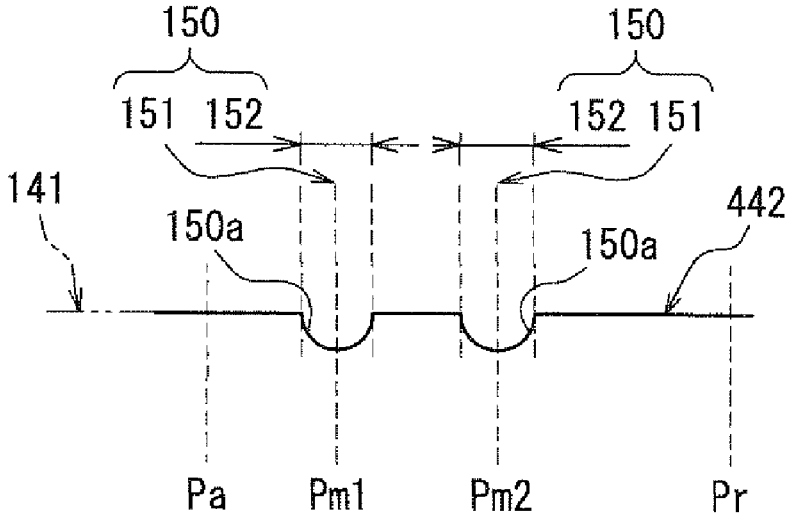
FIG. 10 is a schematic diagram illustrating a valve timing adjusting apparatus according to the fourth embodiment of the present invention.

The fourth embodiment of the present invention is shown in FIG. 10. The fourth embodiment is a modification of the third embodiment. The fourth embodiment shows an example, where multiple receiver parts 150 are provided on a contact part 442. More specifically, in the present embodiment, two receiver parts 150 are provided.

As shown in FIG. 10, each of intermediate phases Pm1, Pm2 is provided to the respective neutral region 151 of the two receiver parts 150. As a result, in a case, where the intermediate phase limitation control is performed to each of the intermediate phases Pm1, Pm2, the engine phase is easily held at the intermediate phase Pm1, Pm2 regions.

Also, because the pressure of oil supplied in the advance supply operation and retard supply operation is relatively kept high during the normal operation other than the starting of the engine, a target intermediate phase is selectable among the intermediate phase Pm1 and the intermediate phase Pm2 during the above normal operation. As a result, the target intermediate phase for the next start operation is selected appropriately to the operational state of the internal combustion engine.

Other Embodiment

Although some embodiments of the present invention have been described above, interpretation of the present invention is not limited to the above embodiments. The present invention is applicable to various embodiments provided that the various embodiments do not deviate from the gist of the present invention.

Specifically, the relation between "advance" and "retard" described in the above embodiments may be reversed in another embodiment. In other words, "advance" and "retard" defined in the above embodiments are interchangeable with each other in another embodiment.

Also, the inclination portions 142*a*, 142*b* of the contact part 142 may be configured to have an inclined surface shape that either increases or decreases the restoring force F of the resilient member 110 relative to the projection portion 121 of the bush 120. Because the bias torque Tu generated by the bias mechanism 100 and the inclination portions 142*a*, 142*b* may be applied to shift the engine phase in the advance direction or the retard direction, the angle of the inclined surface of each of the inclination portions 142*a*, 142*b* is set as required.

Also, the bush 120 is provided to the shoe housing 12 such that the bush 120 is rotatable integrally with the shoe housing 12 and such that the bush 120 is displaceable in the longitudinal direction relative to the shoe housing 12. The bush 120 is provided to the vane rotor 14 such that the bush 120 is rotatable relative to the vane rotor 14 and the bush 120 is displaceable in the longitudinal direction relative to the vane rotor 14. However, the bush 120 is not limited to the above. Alternatively, the bush 120 may be provided such that the bush 120 is rotatable integrally with the vane rotor 14 and the bush 120 is displaceable in the longitudinal direction relative to the vane rotor 14. Also, the bush 120 may be provided to the shoe housing 12 such that the bush 120 is rotatable relative to the shoe housing 12 and the bush 120 is displaceable in the longitudinal direction relative to the shoe housing 12. In the above alternative case, the resilient member 110 is provided between the vane rotor 14 and the bush 120, and the inclination portion of the contact part is provided to the bottom portion of the shoe housing 12.

In the above embodiments, the resilient member 110 is the compression spring. However, the resilient member 110 is not limited to the above, and alternatively, the resilient member 110 may be other resilient or elastic body that is capable of exerting the restoring force when the resilient or elastic body is contracted in a longitudinal direction.

Further more, the above components 24, 26, 28, 29 that are associated with the lock pin 20 and the bias member 22 may not be provided in the drive unit 10.

Also, the pump 4 may employ an alternative pump provided that the alternative pump is capable of running synchronously with the internal combustion engine. For example, the pump 4 may employ an electric pump that operates in response to the energization for the operation of the internal combustion engine.

Also, the present invention is alternatively applicable to an apparatus for adjusting valve timing of an intake valve that serves as a "valve". In addition, the present invention is alternatively applicable to another apparatus for adjusting valve timing of both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus for adjusting timing of a valve that is opened and closed by a camshaft through torque transmitted from a crankshaft of an internal combustion engine, the valve timing adjusting apparatus comprising:

a driving-side rotor that is rotatable synchronously with the crankshaft;

a driven-side rotor that is rotatable synchronously with the camshaft, wherein:

the driven-side rotor and the driving-side rotor define therebetween an advance chamber and a retard chamber that are arranged one after another in a circumferential direction;

the driven-side rotor is rotated relative to the driving-side rotor in an advance direction when working fluid is supplied to the advance chamber from an external fluid supplier working together with an operation of the internal combustion engine; and the driven-side rotor is rotated relative to the driving-side rotor in a retard direction when working fluid is supplied to the retard chamber from the fluid supplier; and a bias mechanism that is provided to one of the driving-side and driven-side rotors, wherein:

the bias mechanism includes a resilient member and a projection portion;

the projection portion is rotatable synchronously with the one of the driving-side and driven-side rotors;

the projection portion is rotatable relative to the other one of the driving-side and driven-side rotors and contacts a contact part of the other one of the driving-side and driven-side rotors;

the projection portion and the resilient member are arranged such that a restoring force of the resilient member is applied to the other one of the driving-side and driven-side rotors;

the contact part of the other one of the driving-side and driven-side rotors includes a receiver part that is configured to support the projection portion;

the receiver part is configured to increase the restoring force of the resilient member when the other one of the driving-side and driven-side rotors is rotated relative to the one of the driving-side and driven-side rotors in the advance direction or in the retard direction;

the receiver part is a recess that is configured to receive the projection portion;

the recess includes an inner peripheral surface that is configured to generate a first biasing force and a second biasing force based on the restoring force of the resilient member;

the first biasing force is applied in a direction normal to the inner peripheral surface;

the second biasing force is applied in a first rotational direction such that the other one of the driving-side and driven-side rotors is rotated relative to the one of the driving-side and driven-side rotors in the advance direction when the projection portion contacts a retard part of the inner peripheral surface; and the second biasing force is applied in a second rotational direction opposite from the first rotational direction such that the other one of the driving-side and driven-side rotors is rotated relative to the one of the driving-side and driven-side rotors in the retard direction when the projection portion contacts an advance part of the inner peripheral surface.

2. The valve timing adjusting apparatus according to claim 1, wherein:

the receiver part includes an inclination portion that is configured to increase and decrease the restoring force of the resilient member;

the inclination portion is configured to convert the restoring force of the resilient member into bias torque that biases the one of the driving-side and driven-side rotors such that a phase of the other one of the driving-side and driven-side rotors relative to the one of the driving-side and driven-side rotors is shifted in one of the advance direction and the retard direction;

the inclination portion includes an advance inclined surface and a retard inclined surface;

the advance inclined surface is configured to increase bias torque such that the phase is shifted in the advance direction;

the retard inclined surface is configured to increase bias torque such that the phase is shifted in the retard direction; and the receiver part is configured to hold the projection portion at a connection between the advance inclined surface and the retard inclined surface.

3. The valve timing adjusting apparatus according to claim 1, wherein:

the projection portion includes a rolling element at an end of the projection portion; and the rolling element rolls on the contact part.

4. The valve timing adjusting apparatus according to claim 1, wherein:

the bias mechanism includes a support shaft portion that receives the resilient member therein and supports the driving-side and driven-side rotors from inner sides of the driving-side and driven-side rotors;

the one of the driving-side and driven-side rotors includes a first support hole that opens to one end of the support shaft portion;

the first support hole receives the resilient member therein;

the other one of the driving-side and driven-side rotors includes a second support hole that opens to the other end of the support shaft portion;

the support shaft portion is slidable along an inner periphery of the second support hole; and the contact part that is opposed to the projection portion is provided to a bottom portion of the second support hole.

5. The valve timing adjusting apparatus according to claim 4, wherein the projection portion is provided to an outer peripheral portion of the support shaft portion.

6. The valve timing adjusting apparatus according to claim 1 further comprising:

a control unit that controls an advance supply operation for supplying working fluid to the advance chamber and a retard supply operation for supplying working fluid to the retard chamber.

7. A valve timing adjusting apparatus for adjusting timing of a valve that is opened and closed by a camshaft through torque transmitted from a crankshaft of an internal combustion engine, the valve timing adjusting apparatus comprising:

a driving-side rotor that is rotatable synchronously with the crankshaft;

a driven-side rotor that is rotatable synchronously with the camshaft, wherein:

the driven-side rotor and the driving-side rotor define therebetween an advance chamber and a retard chamber that are arranged one after another in a circumferential direction;

the driven-side rotor is rotated relative to the driving-side rotor in an advance direction when working fluid is supplied to the advance chamber from an external fluid supplier working together with an operation of the internal combustion engine; and the driven-side rotor is rotated relative to the driving-side rotor in a retard direction when working fluid is supplied to the retard chamber from the fluid supplier; and a bias mechanism that is provided to one of the driving-side and driven-side rotors, wherein:

the bias mechanism includes a resilient member and a projection portion;

the projection portion is rotatable synchronously with the one of the driving-side and driven-side rotors;

the projection portion is rotatable relative to the other one of the driving-side and driven-side rotors and contacts a contact part of the other one of the driving-side and driven-side rotors;

the projection portion and the resilient member are arranged such that a restoring force of the resilient member is applied to the other one of the driving-side and driven-side rotors;

the contact part of the other one of the driving-side and driven-side rotors includes a receiver part that is configured to support the projection portion;

the receiver part is configured to increase the restoring force of the resilient member when the other one of the driving-side and driven-side rotors is rotated relative to the one of the driving-side and driven-side rotors in the advance direction or in the retard direction;

the receiver part includes an inclination portion that is configured to increase and decrease the restoring force of the resilient member;

the inclination portion is configured to convert the restoring force of the resilient member into bias torque that biases the one of the driving-side and driven-side rotors such that a phase of the other one of the driving-side and driven-side rotors relative to the one of the driving-side and driven-side rotors is shifted in one of the advance direction and the retard direction;

the inclination portion includes an advance inclined surface and a retard inclined surface;

the advance inclined surface is configured to increase bias torque such that the phase is shifted in the advance direction;

the retard inclined surface is configured to increase bias torque such that the phase is shifted in the retard direction; and the receiver part is configured to hold the projection portion at a connection between the advance inclined surface and the retard inclined surface.

8. The valve timing adjusting apparatus according to claim 7, wherein:

the projection portion includes a rolling element at an end of the projection portion; and the rolling element rolls on the contact part.

9. The valve timing adjusting apparatus according to claim 7, wherein:

the bias mechanism includes a support shaft portion that receives the resilient member therein and supports the driving-side and driven-side rotors from inner sides of the driving-side and driven-side rotors;

the one of the driving-side and driven-side rotors includes a first support hole that opens to one end of the support shaft portion;

the first support hole receives the resilient member therein;

the other one of the driving-side and driven-side rotors includes a second support hole that opens to the other end of the support shaft portion;

the support shaft portion is slidable along an inner periphery of the second support hole; and the contact part that is opposed to the projection portion is provided to a bottom portion of the second support hole.

10. The valve timing adjusting apparatus according to claim 9, wherein the projection portion is provided to an outer peripheral portion of the support shaft portion.

11. The valve timing adjusting apparatus according to claim 7 further comprising:

a control unit that controls an advance supply operation for supplying working fluid to the advance chamber and a retard supply operation for supplying working fluid to the retard chamber.

* * * * *